US006188170B1

(12) United States Patent
Shimizu et al.

(10) Patent No.: US 6,188,170 B1
(45) Date of Patent: Feb. 13, 2001

(54) COLOR CATHODE RAY TUBE INCLUDING MASK FRAME WITH PROTRUDING PORTIONS

(75) Inventors: Norio Shimizu; Shinichiro Nakagawa, both of Fukaya; Masatsugu Inoue, Kumagaya, all of (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/132,414

(22) Filed: Aug. 11, 1998

Related U.S. Application Data

(63) Continuation-in-part of application No. 08/889,951, filed on Jul. 10, 1997, now abandoned.

(30) Foreign Application Priority Data

Jul. 12, 1996 (JP) ..... 8-183160
Aug. 11, 1997 (JP) ..... 9-216390

(51) Int. Cl.[7] ..... H01J 29/07
(52) U.S. Cl. ..... 313/407
(58) Field of Search ..... 313/407, 408, 313/402

(56) References Cited

U.S. PATENT DOCUMENTS 4,308,485 12/1981 Ignazio ..... 313/407
4,748,371 * 5/1988 Bauder ..... 313/407
4,949,009 8/1990 Iwamoto ..... 313/407
5,029,256 * 7/1991 Tokita et al. ..... 313/407
5,898,259 * 4/1999 Reyal ..... 313/407

FOREIGN PATENT DOCUMENTS 004 245 9/1979 (EP) ..... H01J/29/07
5-121009 5/1993 (JP) ..... H01J/29/02

OTHER PUBLICATIONS

Patent Abstracts of Japan, vol. 17, No. 480 (E–1425) May 18, 1993 re JP–05/121009.

* cited by examiner

*Primary Examiner*—Michael H. Day
(74) *Attorney, Agent, or Firm*—Pillsbury Madison & Sutro LLP

(57) ABSTRACT

A shadow mask opposing a phosphor screen includes a substantially rectangular mask body having a number of electron beam passage apertures, and a substantially rectangular mask frame having four side walls supporting a periphery of the mask body. Among the side walls, a pair of long side walls each has a central connecting portion which is located at a central portion thereof in lengthwise direction and fixed to the mask body, and a pair of protruding portions which are provided on both sides of the central connecting portion in the lengthwise direction and protrude in a direction apart from the mask body. Each protruding portion defines a gap between the side wall and the mask body, and a width of the gap gradually increases as it goes far from the central connecting portion.

12 Claims, 9 Drawing Sheets

COLOR CATHODE RAY TUBE INCLUDING MASK FRAME WITH PROTRUDING PORTIONS

CROSS-REFERENCE TO RELATED APPLICATIONS

This is a Continuation-in-Part application of U.S. patent application Ser. No. 08/889,951, filed Jul. 10, 1997, now abandoned the entire contents of which are incorporated herein by reference.

BACKGROUND OF THE INVENTION

The present invention relates to a shadow mask type color cathode ray tube.

Generally, a color cathode ray tube comprises an envelope including a substantially rectangular panel in which a skirt portion is provided on a periphery of an effective portion thereof, and a funnel connected to the skirt portion. On the inner surface of the effective portion of the panel is formed a phosphor screen comprising three-color phosphor layers. A shadow mask is disposed inside of the phosphor screen so as to oppose it. An electron gun for emitting three electron beams is disposed in a neck of the funnel. Then, the three electron beams emitted from the electron gun are deflected by a magnetic field generated from a deflection apparatus provided outside of the funnel, and vertically and horizontally scan the phosphor screen through the shadow mask, thereby displaying color image on the phosphor screen.

The shadow mask is used for selecting three electron beams and comprises a substantially rectangular mask body in which a number of electron beam passage apertures are formed on a region opposing the phosphor screen and a substantially rectangular mask frame having side walls fixed to the periphery of the mask body. As a shadow mask supporting method, according to some type thereof, substantially wedge shaped elastic supports are provided at corners of the mask frame and these elastic supports are engaged with stud pins provided at the skirt portion of the panel, so that the shadow mask is detachably supported thereby.

Generally, in order to display color picture images having no deviation in color on the phosphor screen of the color cathode ray tube, three electron beams which pass the electron beam passage apertures in the mask body must be landed properly on the corresponding three color phosphor layers. For this purpose, it is necessary to keep the shadow mask at a proper position relative to the panel.

To meet recent trend of multi-media, there is provided a color cathode ray tubes in which the size of three color phosphor layers and their arrangement pitch are reduced to increase its resolution. In such a color cathode ray tube, allowance to deviation of beam landing relative to the three color phosphor layers has dropped so that more accurate beam landing than ordinary color cathode ray tubes is demanded.

However, in conventional color cathode ray tubes, the shadow mask is so constructed that almost entire periphery of the mask body is in contact with the side walls of the mask frame. Thus, there sometimes occurs a case in which the shadow mask may be deviated from its proper position because a undesired force is applied to the mask body due to disparity in quality of the mask frame resulting from production. Particularly in recent color cathode ray tubes having aspect ratio of 16:9, the side wall on the long side of the mask frame is much longer than the side wall on the short side as compared to ordinary color cathode ray tubes. Thus, the mask body is likely to be deformed because of insufficient strength and a disparity in distance between the opposing side walls on the long side (distance in the direction of the short axis).

In manufacturing process for the color cathode ray tubes, fitting and removal of the shadow mask are carried out repeatedly. Due to a force applied to the shadow mask during this fitting and removal operation, a distortion may occur in the mask frame so that the mask body may be deformed. If such a phenomenon occurs, a deviation in beam landing to the three color phosphor layers is produced.

On the other hand, in color cathode ray tubes for the multi-media, which have a small allowance in beam landing to the three color phosphor layers, it is necessary to reduce a load on the elastic supports by reducing the weight of the mask frame occupying most part of the weight of the shadow mask so as to relax the deviation of the shadow mask due to external shock. However, if the weight of the mask frame is reduced, it is likely that the mask frame is deformed due to an external shock or a force applied when the shadow mask is fitted or removed so that the shadow mask is deviated relative to the panel.

Further, although such a procedure has been taken as to reduce the thickness of the mask body thereby equalizing the size and shape of the electron beam passage apertures which are a prominent reason for generation of unevenness of the phosphor screen, reducing the thickness of the mask body likely induces a reduction of the strength thereby producing a deformation of the mask body itself.

There have bee provided a color cathode ray tube employing a low thermal expansion type shadow mask which is made of amber material having a high effect of suppressing a transition of electron beams due to so-called doming that the shadow mask is expanded in a direction of the phosphor screen due to thermal expansion of the shadow mask. As a measure for preventing a deformation of such a low thermal expansion type shadow mask, Jpn. Pat. Appln. KOKAI No. 5-121009 has disclosed a shadow mask in which a plurality of protruding portions which protrude outwardly are provided on side walls of the mask frame. However, even in the case in which such protruding portions are provided, since the mask body and the mask frame are in contact with each other through planes, a deformation of the mask body is generated due to disparity in production of the mask frame or deformation of the mask frame in a manufacturing process of color cathode ray tubes.

As described above, design of the mask frame is important in order to display picture images having no deviation in color on the phosphor screen. However, conventional shadow masks have such a problem that the mask body or mask frame is deformed and it is difficult to display high quality images.

BRIEF SUMMARY OF THE INVENTION

The present invention has been contrived in consideration of the above circumstances and its object is to provide a color cathode ray tube which is capable of suppressing effectively a deformation of the mask body or the mask frame and displaying high quality images.

According to one aspect of the present invention, there is provided a color cathode ray tube comprising: an envelope including a panel having a substantially rectangular effective portion in which a phosphor screen is formed on an inner surface thereof, a skirt portion provided on a periphery of the panel, and a funnel fixed to the skirt portion; a shadow mask arranged in the envelope so as to oppose the phosphor screen; and an elastic support elastically supporting the shadow mask relative to the skirt portion.

The shadow mask comprises a substantially rectangular mask body in which a number of electron beam passage apertures are formed, and a substantially rectangular mask frame having four side walls supporting the periphery of the mask body.

At least two side walls opposing each other include connecting portions which are provided at their central portions in a lengthwise direction and connected to the mask body, and a pair of protruding portions which are provided on both sides of the connecting portion and protrude in a direction apart from the mask body. Each of the protruding portions defines a gap between the side wall and the mask body and the gap includes that portion whose width gradually increases as it goes far from the connecting portion.

According to another aspect of the present invention, there is provided a color cathode ray tube wherein the shadow mask comprises a substantially rectangular mask body in which a number of electron beam passage apertures are formed, and a substantially rectangular mask frame having four side walls supporting the periphery of the mask body. Each of a pair of the side walls on a long side of the side walls has connecting portions, which are fixed to the mask body, only at its central portion in the lengthwise direction and its both end portions in the lengthwise direction, and those portions of each side wall on the long side other which are other than the connecting portions oppose the mask body with a gap.

According to the color cathode ray tube having such a construction, since the mask frame of the shadow mask has protruding portions formed on the side walls, the mechanical strength of the side walls and the entire mask frame are improved thereby reducing a deformation of the mask frame and a deformation of the mask body resulting therefrom. Consequently, deviation of the position of the shadow mask relative to the phosphor screen is suppressed so that high quality images can be displayed.

Further, by defining a gap between the side wall of the mask frame and the mask body, a contact area therebetween is reduced so that influence upon the mask body of the disparity in size of the mask frame or deformation of the mask frame can be reduced.

By optimizing the shape of the mask frame and fixing of the mask body relative to the mask frame as described above, it is possible to reduce deviation of beam landing which may occurs due to deviation of the mask body relative to the mask frame and deformation of the mask body resulting from a deformation of the mask frame.

According to a still another aspect, there is provided a color cathode ray tube comprising: an envelope including a panel having a substantially rectangular effective portion in which a phosphor screen is formed on an inner surface thereof and a skirt portion provided on a periphery of the panel, and a funnel attached to the skirt portion; a shadow mask arranged in the envelope to oppose the phosphor screen; and an elastic support elastically supporting the shadow mask relative to the skirt portion; the shadow mask including a substantially rectangular mask body having a number of electron beam passage apertures, and a substantially rectangular mask frame having four side walls supporting the periphery of the mask body.

At least two side walls opposing each other of the mask frame have a protruding portion protruding in a direction to be apart from the mask body and defining a gap between the side wall and the mask body, and beads protruding toward the inside of the mask frame from the protruding portion and such that it is not in contact with the mask body.

According to the color cathode ray tube having such a structure, the mask frame has the protruding portions and beads formed on the side walls. Therefore, the mechanical strength of the side walls and entire mask frame is improved so that the deformation of the mask frame and a resulting deformation of the mask body are reduced. As a result, a deviation of the position of the shadow mask relative to the phosphor screen is suppressed thereby enabling to display an excellent picture.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

FIGS. 1 to 4 show a color cathode ray tube according to a first embodiment of the present invention, in which:

FIG. 1 is a sectional view of the color cathode ray tube;

FIG. 2 is a perspective view schematically showing an electron gun, a shadow mask and a phosphor screen of the color cathode ray tube;

FIG. 4 is an enlarged plan view of a side wall of the shadow mask;

DETAILED DESCRIPTION OF THE INVENTION

Hereinafter, a color cathode ray tube according to an embodiment of the present invention will be described in detail with reference to the accompanying drawings.

Figure 1:
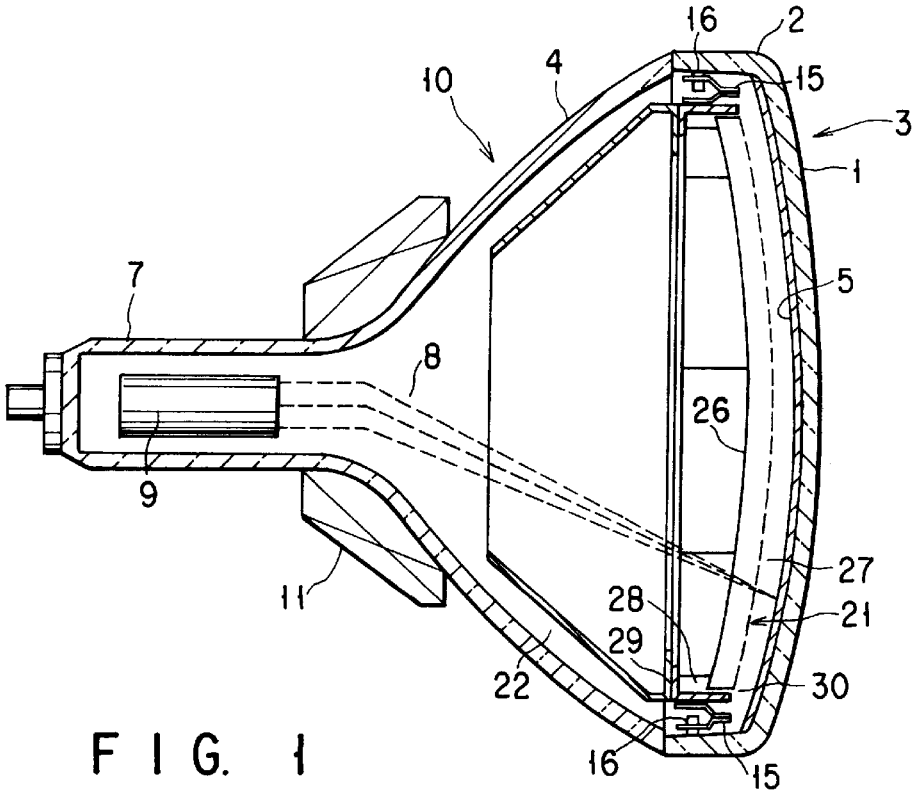
Figure 2:
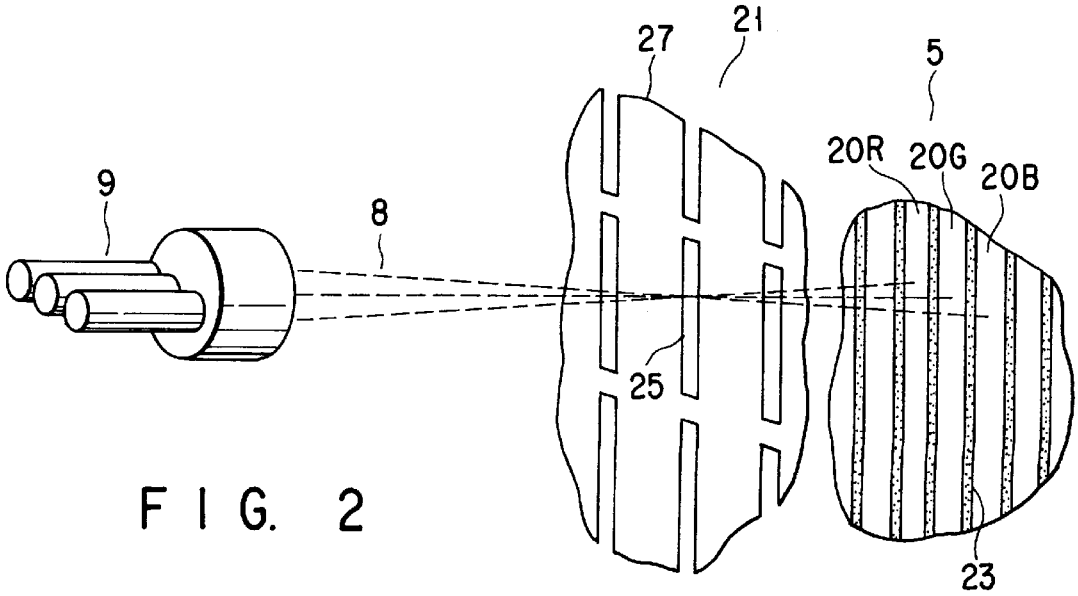

As shown in FIGS. 1 and 2, the color cathode ray tube comprises a vacuum envelope 10 formed of glass. The vacuum envelope 10 comprises a panel 3 including a substantially rectangular effective portion 1 and a skirt portion 2 provided on the periphery of the effective portion, and a funnel 4 attached to the skirt portion 2. On an inner surface of the effective portion 1 of the panel 3 is formed a phosphor screen 5 including stripe shaped three color phosphor layers 20B, 20G, 20R emitting blue, green and red colors, and stripe shaped light shielding layer 23 formed between the phosphor layers. A shadow mask 21 which will be described later is disposed in the envelope 10 to oppose the phosphor screen 5.

An electron gun 9 for emitting three electron beams 8 is disposed within a neck 7 of the funnel 4. The three electron beams 8 emitted from the electron gun 9 are deflected by a magnetic field generated from a deflection apparatus 11 provided outside of the funnel 4, and horizontally and vertically scan the phosphor screen 5 through the shadow mask 21, thereby displaying color images on the phosphor screen.

As shown in FIGS. 1 to 3B, the shadow mask 21 comprises a substantially rectangular mask body 27 and a mask frame 30 supporting the mask body 27. The mask body 27 includes a substantially rectangular effective portion 27*a* which is opposed to the phosphor screen 5 and has a number of electron beam passage apertures 25, and a skirt portion 26 formed on the periphery of the effective portion 27*a*. The mask frame 30 is formed in a substantially rectangular and has a pair of side walls 28L on its long side and a pair of side walls 28S on its short side. The mask body 27 is supported by welding the skirt portion 26 thereof to the mask frame 30.

Among the side walls of the mask frame 30, the pair of the side walls 28L on the long side are fixed to the mask body 27 while only a central portion thereof in the lengthwise direction and its both ends in the lengthwise direction are in contact with the skirt portion 26 of the mask body 27, and each side wall 28L has those portions which are not in contact with the skirt portion 26 of the mask body 27.

Figure 3A:
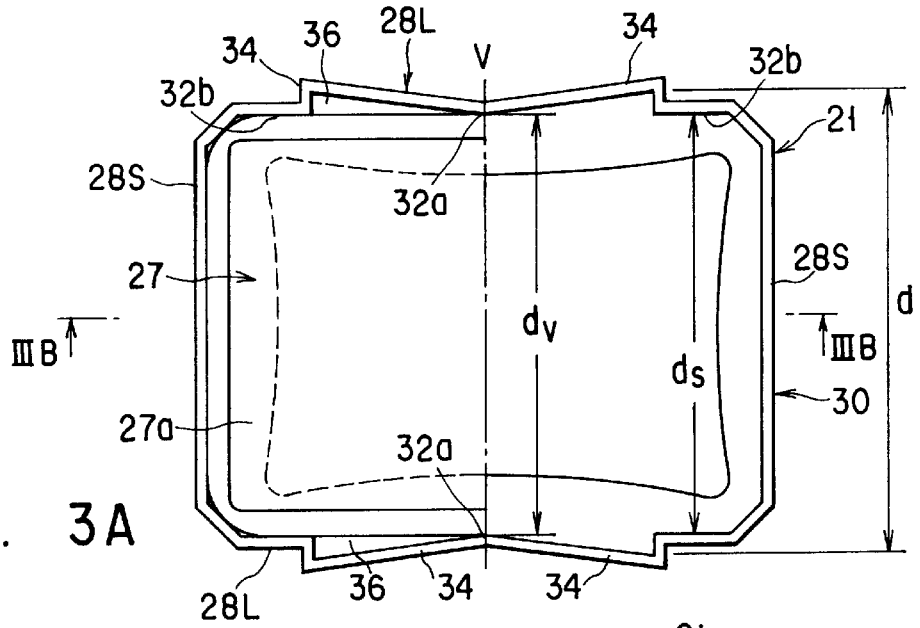
FIG. 3A is a plan view of the shadow mask.
Figure 3B:
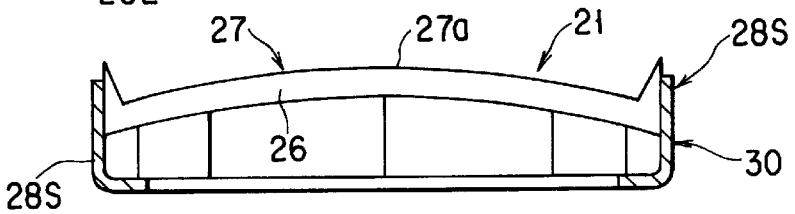
FIG. 3B is a sectional view taken along the lines IIIB—IIIB in FIG. 3A.
Figure 4:
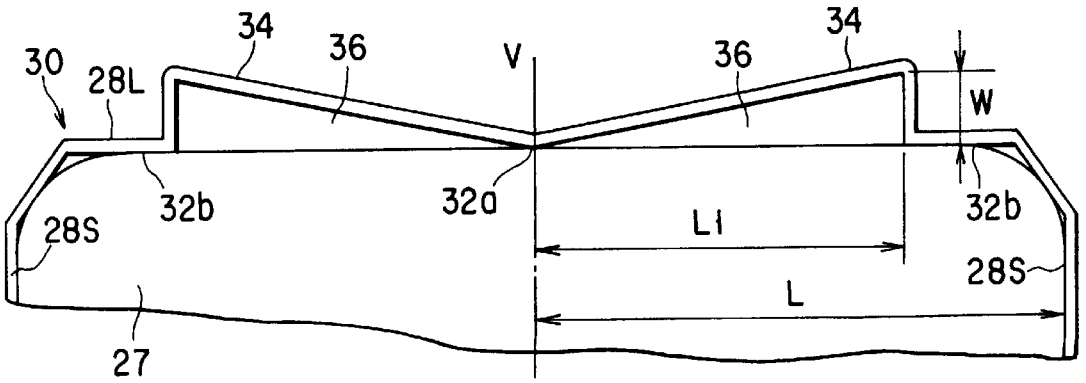

If speaking in detail, as shown in FIGS. 3A, 3B and 4, the respective side walls 28L are bent symmetrically with respect to a short axis V of the mask frame 30 such that a central connecting portion 32*a* and a pair of end connecting portions 32*b* which are in contact with the skirt portion 26 of the mask body 27 are formed in the center portion in the lengthwise direction and both ends in the lengthwise direction.

On both sides of the central connecting portion 32*a* are wedge-shaped protruding portions 34 which protrude in a direction to be apart from the mask body 27. A distance d between the pair of the side walls 28L at the positions of the protruding portions 34 is larger than a distance dv between the side walls 28L on the short axis V and a distance ds between the side walls 28L in the vicinity of the side walls 28S on the short side.

Each long side portion of the skirt portion 26 of the mask body 27 is located inside the mask frame 30 and is in contact with the central connecting portion 32*a* and the end connecting portions 32*b* of the corresponding side walls 28L and welded to the central connecting portion 32*a* and the end connecting portions 32*b*. A pair of gaps 36 are defined between each of the side walls 28L and the mask body 27 by the protruding portions 34 and located on both sides of the central connecting portions 32*a*. The respective gaps 36 are formed in a wedge shape whose width gradually expands from the central connecting portion 32*a* toward the end connecting portion 32*b*.

The maximum width w of each gap 36 is set in about 1 to 3 mm and assuming that a distance between the short axis V and the side wall 28S is L, the length L1 of the gap 36 in the longitudinal direction of the side wall 28L is L1=0.7 to 0.9L.

On the other hand, the skirt portion 26 on the short side of the mask body 27 is in contact with the inside of the entire length of the side wall 28S on the short side of the frame 30 and welded to the side wall 28S at several appropriate points.

As shown in FIG. 1, the shadow mask 21 having the above structure is detachably supported by the panel 3 by engaging wedge shaped elastic supports 15 fixed to corner portions of the mask frame 30 with stud pins 16 protruding from the skirt portion 2 of the panel 3, respectively. In FIG. 1, reference numeral 22 denotes an internal magnetic field shielding body attached to the shadow mask 21.

According to the color cathode ray tube having the above-mentioned arrangement, by forming the protruding portions 34 on the side walls 28L of the mask frame 30, the mechanical strength of the mask frame 30 is improved. Thus, it is possible to prevent the shadow mask 21 from being deformed by an external force applied thereto and effectively reduce a deviation of the shadow mask with respect to the panel 3. Particularly in a color cathode ray tube having an aspect ratio of 16:9, the side walls on the long side of the mask frame is much longer than ordinary cathode ray tubes, and therefore the mask body is likely to be deformed due to a shortage of strength and disparity of the distance between opposing side walls on the long side. However, by forming the shadow mask 21 in the structure described above, it is possible to effectively prevent the shadow mask from being deformed.

Further, the gap 36 is defined between the mask body 27 and the side wall 28L by forming the protruding portions 34 on the side walls 28L of the mask frame 30. Thus, each side wall 28L is in contact with the mask body 27 only through the central connecting portion 32*a* and the end connecting portions 32*b* so that a contacting area between the mask frame 30 and the mask body 27 can be reduced largely as compared to conventional examples. As a result, it is possible to reduce undesired forces applied to the mask body 27 due to disparity of the mask frame 30 upon manufacturing. Particularly, by accurately controlling the distance between the mask frame 30 and the mask body 27, that is, only distances dv and ds, it is possible to reduce deformation of the mask body 27 thereby preventing a deviation of the shadow mask 21 with respect to the panel 3. As a result, it is possible to reduce deviation of beam landing relative to the three color phosphor layers composing the phosphor screen, thereby displaying high quality images.

Further, because of formation of the protruding portions 34, the mask frame 30 is reinforced. Thus, the weight of the mask frame may be reduced so that burden on the elastic supports can be reduced. Further, even if the thickness of the mask body 27 is reduced, the deformation thereof can be prevented.

In the embodiment described above, each side wall 28L of the mask frame 30 has the wedge-shaped protruding portions 34 and the gaps 36 defined by these protruding portions 34. If the side wall 28L is so structured as to be in contact with the mask body 27 through only the central portion and both ends portions in the lengthwise directions, the shapes of the protruding portions 34 and the gaps 36 may be changed in various ways as required.

Figure 5A:
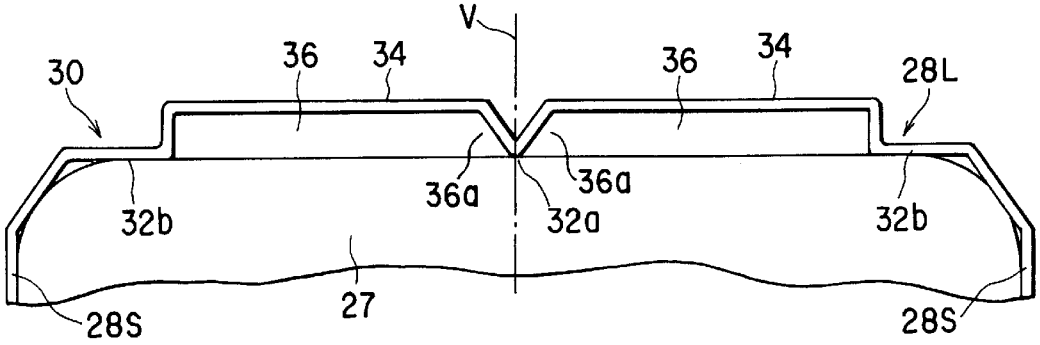
FIGS. 5A to 5C are plan views respectively showing different modifications of the side walls of the shadow mask.

For example, according to a modification shown in FIG. 5A, the respective protruding portions 34 are formed in substantially rectangular shape and each gap 36 is formed such that only end portion 36*a* on the central connecting portion 32*a* side gradually expand in terms of width from the central connecting portion 32*a* toward the end connecting portion 32*b* and the remaining parts are formed with a constant width.

Figure 5B:
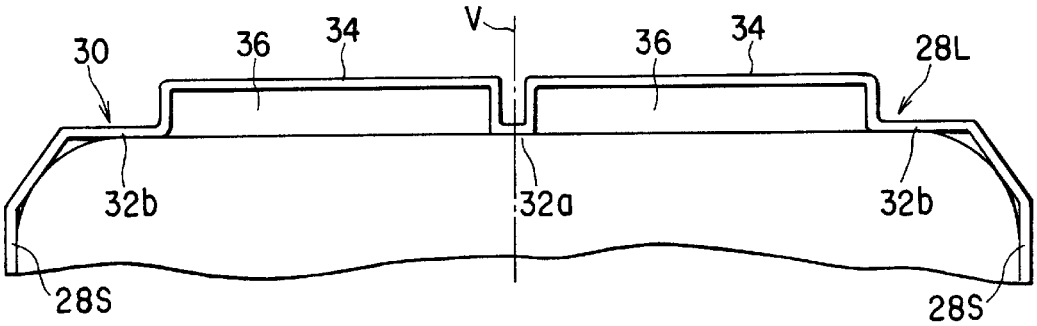

According to a modification shown in FIG. 5B, the respective protruding portions 34 are formed in rectangular shape and the gaps 36 are formed in a constant width along the entire region in its lengthwise direction.

Figure 5C:
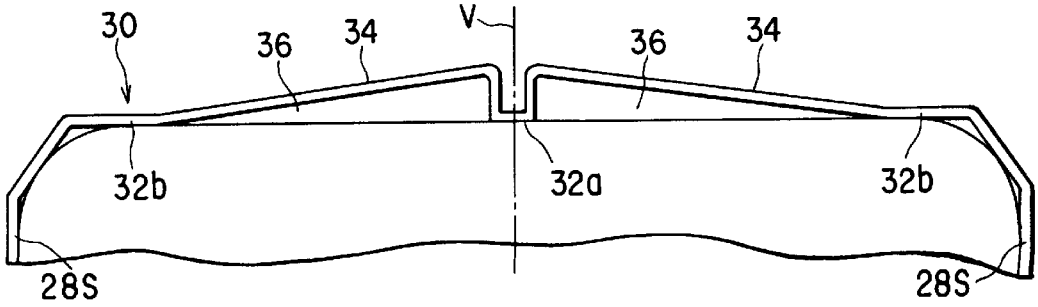

According to a modification shown in FIG. 5C, the respective protruding portions 34 and the gaps 36 are formed in wedge shape directed in a direction opposite to the previously described embodiments. Specifically, the protruding portions 34 and the gaps 36 are formed such that the sides of the central connecting portions 32*a* are the widest and gradually narrow toward. the end connecting portions 32*b*.

Figure 6A:
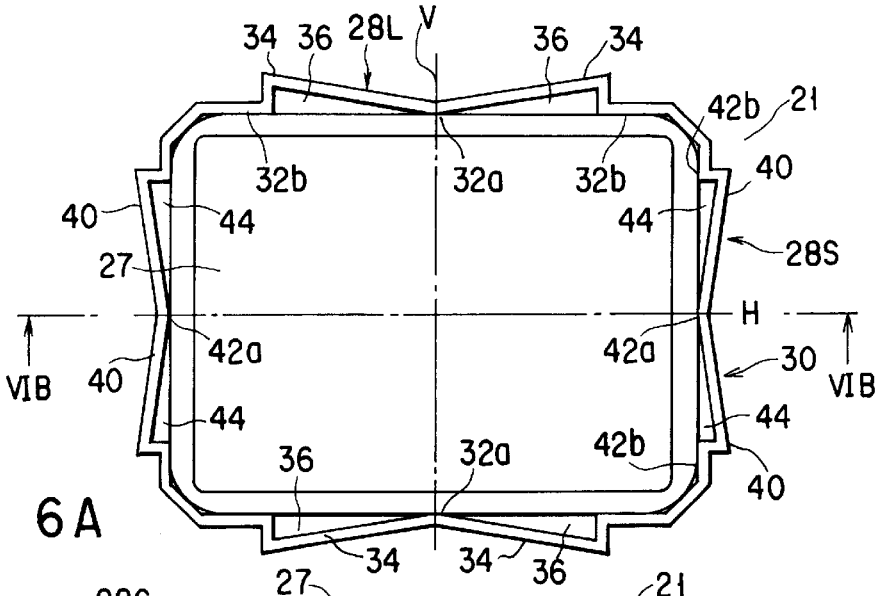
FIG. 6A is a plan view of the shadow mask according to a second embodiment of the present invention.
Figure 6B:
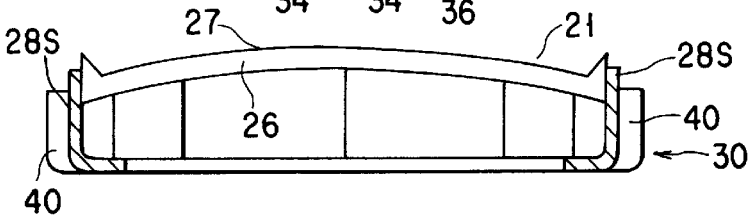
FIG. 6B is a sectional view taken along the lines VIB—VIB in FIG. 6A.

FIGS. 6A and 6B show a shadow mask 21 in the color cathode ray tube according to a second embodiment of the present invention. According to the second embodiment, in the mask frame 30, a pair of protruding portions 40 are formed on the side walls 28S on the short side as well as the side walls 28L on the long side. Each of the side walls 28S is also connected to the mask body 27 such that only its central portion 42*a* and both end portions 42*b* in the lengthwise direction are in contact with the skirt portion 26 of the mask body 27 and has some portions which are not in contact with the skirt portion 26 of the mask body 27.

Namely, each side wall 28S is bent symmetrically with respect to a long axis H of the mask frame 30 such that a central connecting portion 42*a* and a pair of end connecting portions 42*b* which are in contact with the skirt portion 26 of the mask body 27 are formed in the center portion in the lengthwise direction and both ends in the lengthwise direction. Further, wedge-shaped protruding portions 40 which protrude in a direction to be apart from the mask body 27 are formed on both sides of the central connecting portions 42*a*. A distance at the protruding portions 40 between the pair of the side walls 28S is larger than a distance on the long axis H between the side walls 28S and further a distance in the vicinity of the long side between the side walls 28S. The skirt portion 26 of the mask body 27 is located within the mask frame 30 such that each short side portion thereof is in contact with the central connecting portion 42*a* and end connecting portions 42*b* of the corresponding side wall 28*s* and welded to the central connecting portions 42*a* and the end connecting portions 42*b*. A pair of gaps 44 are defined between the side wall 28*s* and the mask body 27 by the protruding portions 40 and located on both sides of the central connecting portion 42*a*. Each gap 44 is formed in wedge shape expanding gradually from the central connecting portion 42*a* toward the end connecting portions 42*b*.

Other constructions of the shadow mask are the same as the first embodiment.

According to the second embodiment having such a structure, the protruding portions 40 are also provided on the side walls 28*s* on the short side, so that the mechanical strength of the mask frame 30 is further improved and a contact area between the mask body 27 and the mask frame 30 is further reduced. Thus deformation of the mask body 27 can be further reduced thereby preventing effectively a deviation of the shadow mask 21 with respect to the panel 3.

Figure 7A:
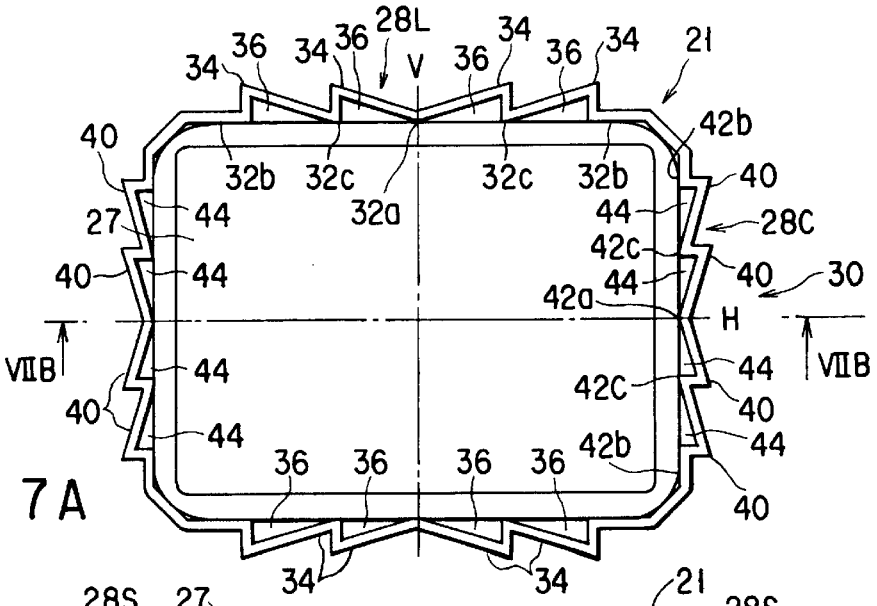
FIG. 7A is a plan view of the shadow mask according to a third embodiment of the present invention.
Figure 7B:
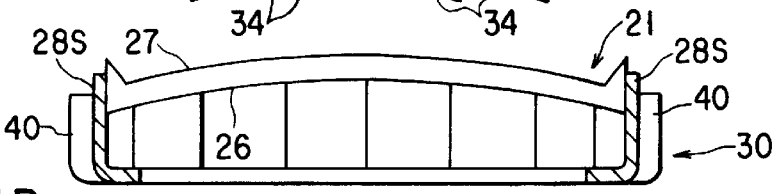
FIG. 7B is a sectional view taken along the lines VIIB—VIIB in FIG. 7A.

FIGS. 7A and 7B show the shadow mask 21 of the color cathode ray tube according to a third embodiment of the present invention. According to the third embodiment, four protruding portions 34 are formed on each of the side walls 28L, 28S of the mask frame 30. That is, two protruding portions 34 are formed each on one side symmetrically with respect to the short axis V on each of the side walls 28L. Each side walls 28L has middle connecting portions 32*c* located between the connecting portions 32*a* and 32*b* in addition to the central connecting portion 32*a* and the end connecting portions 32*b*, and the side wall 28L is welded to the skirt portion 26 of the mask body 27 through these five connecting portions. Between the side wall 28L and the skirt portion 26 are defined four gaps 36 by the protruding portions 34 such that each of the gaps 36 is formed in wedge shape gradually expanding from the central connecting portion 32*a* toward the end connecting portions 32*b*.

Likewise two protruding portions 40 are formed on one side symmetrically on the side wall 28S with respect to the long axis H. Each side wall 28S has middle connecting portions 42*c* located between the connecting portions 42*a* and 42*b* in addition to the central and end connecting portions 42*a* and 42*b*, and each side wall 28S is welded to the skirt portion 26 of the mask body 27 through these five connecting portions. Between the side wall 28S and the skirt portion 26 are defined four gaps 36 by the protruding portions 40 such that each of the gaps is formed in wedge shape gradually expanding from the central connecting portion 42*a* toward the end connecting portions 42*b*.

According to the third embodiment having such a structure, the mask frame 30 is reinforced by forming the protruding portions 34, 40, so that for example if an external shock is applied to the shadow mask 21, that shock can be dispersed depending on the number of the protruding portions. In addition, the same operation and effect as in the first and second embodiments can be obtained.

Figure 8A:
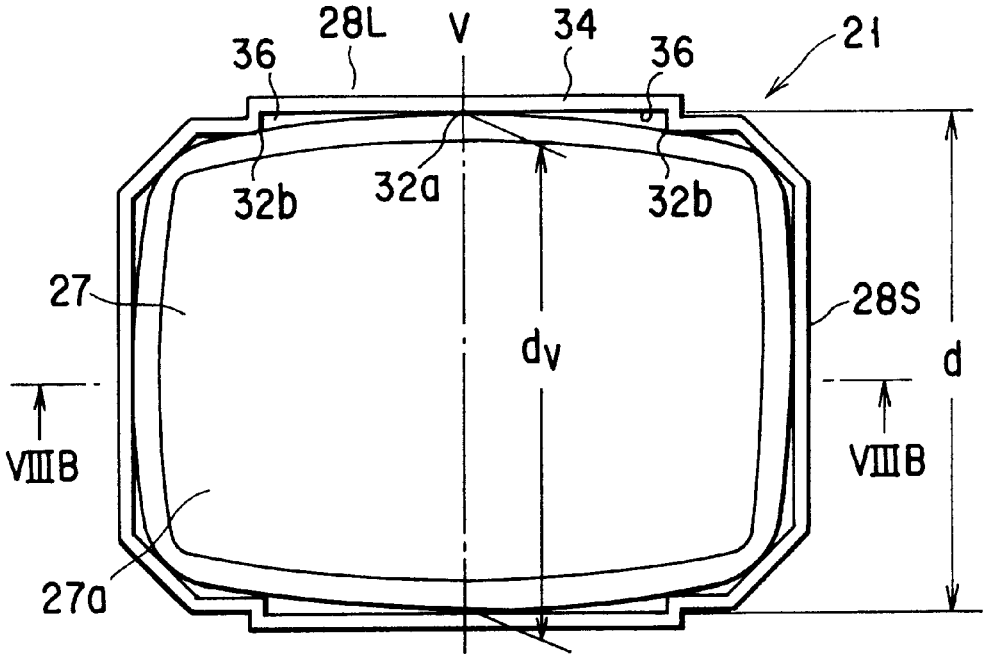
FIG. 8A is a plan view of the shadow mask according to a fourth embodiment of the present invention.
Figure 8B:
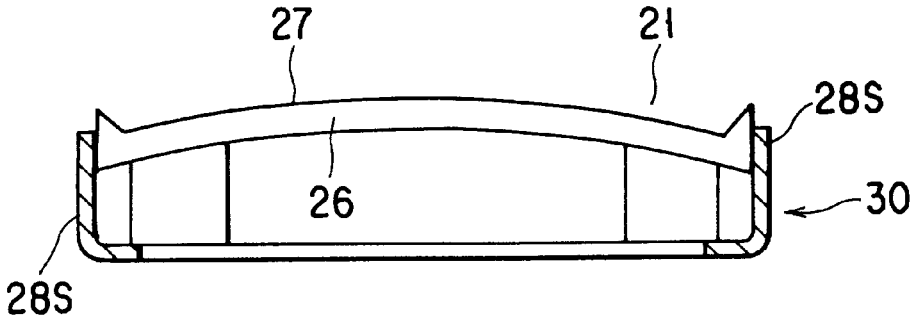
FIG. 8B is a sectional view taken along the lines VIIIB—VIIIB in FIG. 8A.

FIGS. 8A and 8B show the shadow mask of the color cathode ray tube according to a fourth embodiment of the present invention. According to the fourth embodiment, one protruding portion 34 is formed on each side wall 28L on the long side of the mask frame 30, symmetrically with respect to the short axis V. Each of the protruding portions 34 is formed in a constant width along the entire length in its lengthwise direction. Thus, a distance d between the pair of the side walls 28L at the position of the protruding portions 34 is the same as a distance dv between the side walls 28L on the short axis V. An inner surface of the protrude portion 34 is of linear shape having infinite curvature.

Relative to the mask frame 30, the long side portion of the mask body 27 is formed in circular shape protruding toward the side wall side of the mask frame 30. As a result, the side walls 28L are in contact with the long side of the skirt portion 26 of the mask body 27 through only the central connecting portion 32*a* located in the center in the lengthwise direction of the protruding portion 34 and a pair of the end connecting portions 32*b* located on boundaries between the protruding portion and the side wall, and welded to the skirt portion through these connecting portions. On both sides of the central connecting portions 32*a* are defined wedge shaped gaps 36 the width of which is expanded gradually toward the end connecting portions 32*b*.

In the shadow mask 21, the short side of the skirt portion 26 of the mask body 27 is in contact with the almost entire length of the inner surface of the side wall 28S on the short side of the mask frame 30 and fixed at several appropriate welding points.

In the shadow mask according to the fourth embodiment having such a construction, the same operation and effects as in the first embodiment described previously can be obtained.

Figure 9C:
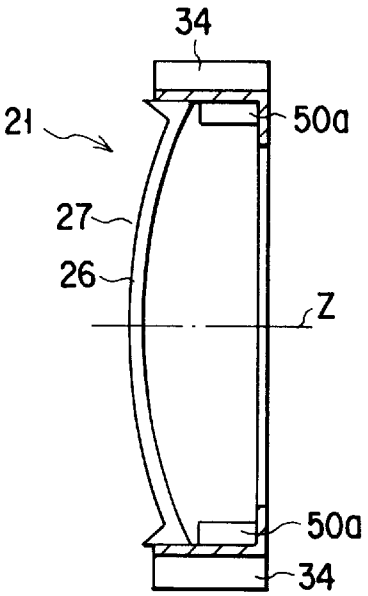
FIG. 9C is a sectional view taken along the lines IXC—IXC of FIG. 9A.
Figure 9A:
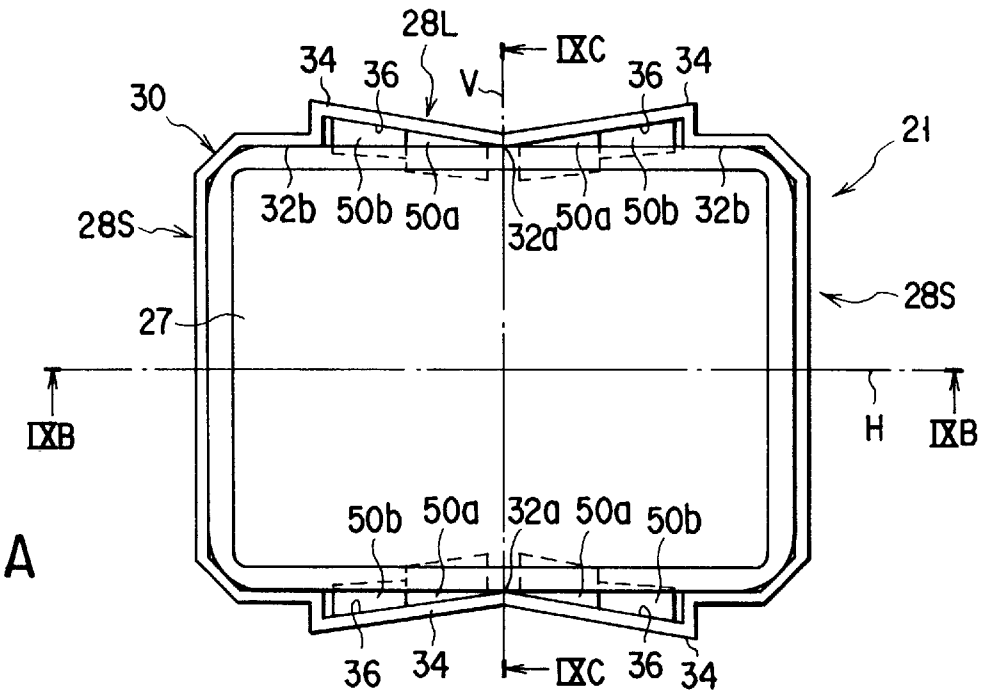
FIG. 9A is a plan view of a shadow mask according to a fifth embodiment of the present invention.
Figure 9B:
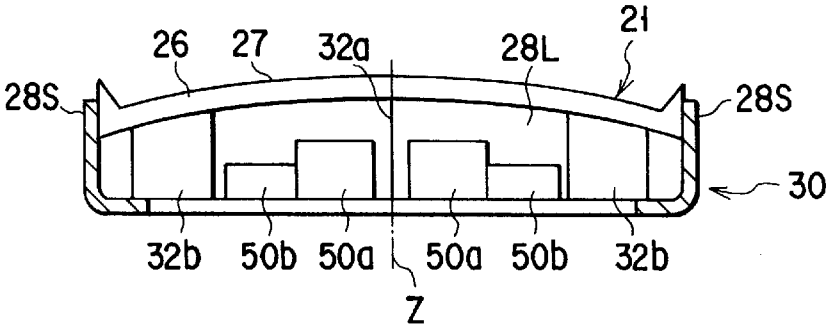
FIG. 9B is a sectional view taken along the lines IXB—IXB of FIG. 9A.

FIGS. 9A to 9C show a shadow mask 21 of a color cathode ray tube according to a fifth embodiment of the present invention. According to the fifth embodiment, in the mask frame 30, the side walls 28L on a long side have a pair of the protruding portions 34 protruding in a direction to be apart from the mask body 27 like the first embodiment shown in FIGS. 3A, 3B and 4, and further beads 50 protruding toward the inside of the mask frame.

Specifically, each of the side walls 28L is bent symmetrically with respect to the short axis V of the mask frame 30 such that a central connecting portion 32*a* and a pair of end connecting portions 32*b* which are in contact with the skirt portion 26 of the mask body 27 are formed in the center portion in the lengthwise direction and on both the ends in the lengthwise direction. On both sides. of the central connecting portion 32*a* are formed the wedge-like protruding portions 34 protruding in the direction to be apart from the mask body 27. Each long side portion of the skirt portion 26 of the mask body 27 is located inside the mask frame 30 and is in contact with the central connecting portion 32*a* and the end connecting portions 32*b* of the corresponding side wall 28L and welded to the central connecting portion 42*a* and the end connecting portions 42*b*. A pair of gaps 36 are defined between each of the side walls 28L and the mask body 27 by the protruding portions 34 and located on both sides of the central connecting portion 32*a*. The respective gaps 36 are formed in a wedge shape whose width gradually expands from the central connecting portion 32*a* toward the end connecting portion 32*b*.

The mask body 27 is attached to the inner surface of that end portion of the mask frame 30 which is located on the panel 3 side.

Each of the side walls 28L has a pair of substantially rectangular beads 50*a*, 50*b* projecting toward the inside of the mask frame 30 from each protruding portion 34 so that totally four beads are provided. These beads 50*a*, 50*b* are arranged in the lengthwise direction of each side wall 28L. The bead 50*a* located near the central connecting portion 32*a* has a longer protruding amount toward the inside of the mask frame 30 and a larger height in the width direction, namely in the direction of the tube axis Z than those of the bead 50*b* located near the end connecting portion 32*b*.

The beads 50*a*, 50*b* are formed in that end portion of the side wall L which is located near the electron gun 9, and they are not in contact with the skirt portion 26 of the mask body 27. The beads 50*a*, 50*b* are disposed 2 to 10 mm, for example, 3 mm apart from the central connecting portion 32*a* and end connecting portion 32*b*, respectively.

The other structure is the same as in the first embodiment and a detailed description thereof will be omitted.

According to the fifth embodiment having such a structure, by providing the side walls 28L with the protruding portions 34, the mechanical strength of the mask frame 30 is improved further and the contacting area between the mask body 27 and mask frame 30 is reduced. Therefore, a deformation of the mask body 27 is reduced and a deviation of the position of the shadow mask 21 with respect to the panel 3 can be effectively prevented. Further, by providing with the beads 50*a*, 59*b*, the long side walls of the mask frame having a relatively low mechanical strength can be intensified, so that when the shadow mask 21 is attached to and detached from the envelope during the manufacturing step of the color cathode ray tube, a force applied to the mask frame 30 is cut by the protruding portion 34 thereby reducing an influence upon the central portion of the side wall and further by the reinforcements by means of the beads 50*a*, 50*b*, the deformation in the vicinity of the central portion of the side wall can be prevented.

If the protrusion and height of the bead 50*a* located near the center of the side wall 28L is larger than the bead 50*b* located near the end portion of the side wall 28L as in this embodiment, the central portion of the side wall of the mask frame, which is relatively low in mechanical strength, is effectively reinforced. Further, a lowering of the position accuracy of the mask body relative to the panel due to deviation of the shape and dimension of the mask frame and the deformation of a portion near the side wall central portion of the mask frame which may occur when the shadow mask is attached or detached, can be prevented effectively. Therefore, it is possible to obtain a color cathode ray tube in which a deviation of beam landing on the phosphor screen is greatly reduced.

Figure 10C:
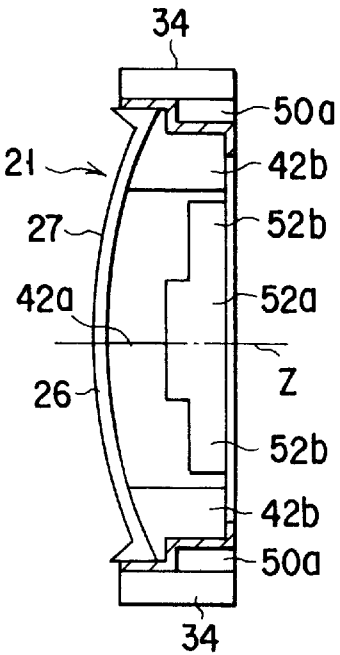
FIG. 10C is a sectional view taken along the lines XC—XC of FIG. 10A.
Figure 10A:
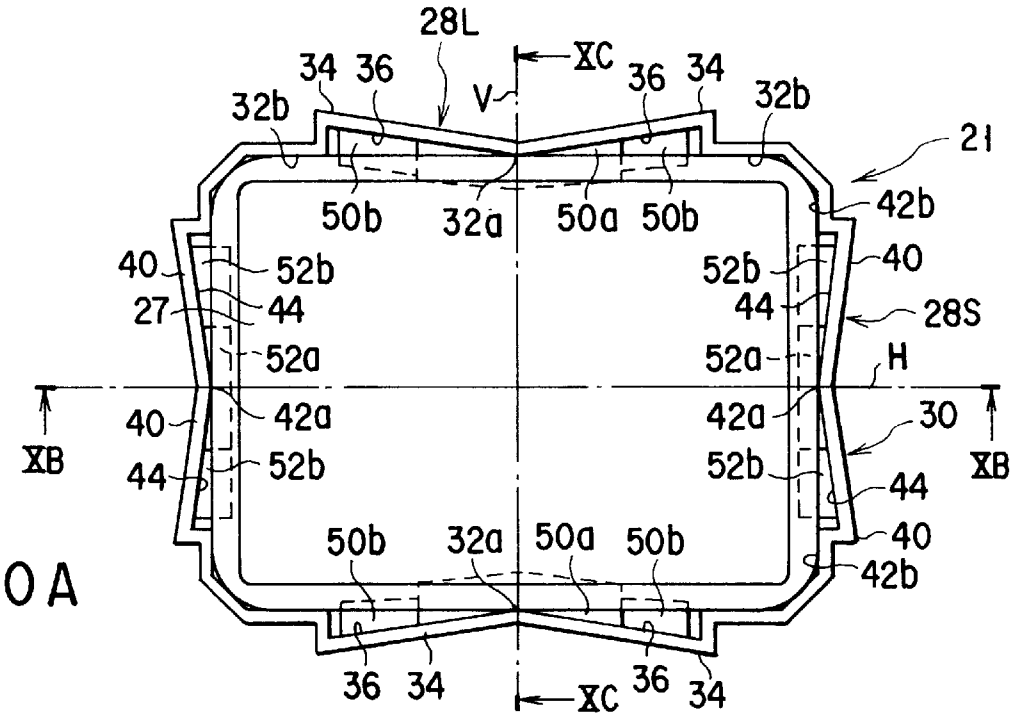
FIG. 10A is a plan view of a shadow mask according to a sixth embodiment of the present invention.
Figure 10B:
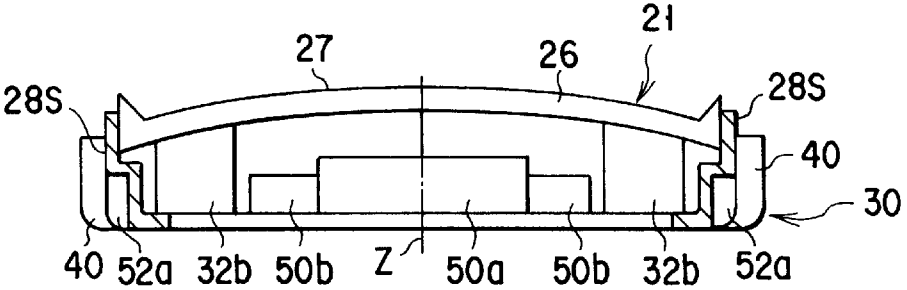
FIG. 10B is a sectional view taken along the lines XB—XB of FIG. 10A.

FIGS. 10A to 10C show a shadow mask 21 of the color cathode ray tube according to a sixth embodiment of the present invention. According to the sixth embodiment, on the mask frame 30, a pair of protruding portions 40 and beads are provided on each of the side walls 28S on the short side as well as the side walls 28L on the long side. On each of the side walls 28S also, only the central portion in the lengthwise direction and both end portions in the lengthwise direction are in contact with the skirt portion 26 of the mask body 27 and connected to the mask body, such that the side wall 28S includes those portions which are not in contact with the skirt portion 26 of the mask body 27.

More specifically, each of the side walls 28S is bent symmetrically with respect to a long axis H of the mask frame 30 such that a central connecting portion 42*a* and a pair of end connecting portions 42*b* which are in contact with the skirt portion 26 of the mask body 27 are formed in the center portion in the lengthwise direction and both ends in the lengthwise direction, respectively. On both sides of the central connecting portion 42*a* are formed wedge-shaped protruding portions 40 which protrude in a direction to be apart from the mask body 27. A distance between the pair of the side walls 28S at the positions of the protruding portions 40 is larger than a distance between the side walls 28S on the long axis H and a distance between the side walls 28S in the vicinity of the side walls 28L on the long sides.

Each short side portion of the skirt portion 26 of the mask body 27 is located inside the mask frame 30 and is in contact with and welded to the central connecting portion 42*a* and the end connecting portions 42*b* of the corresponding side wall 28S. A pair of gaps 44 are defined between each of the side walls 28S and the mask body 27 by the protruding portions 40 and located on both sides of the central connecting portions 42*a*. The respective gaps 44 are formed in a wedge shape whose width gradually expands from the central connecting portion 42*a* toward the end connecting portion 42*b*.

Each of the side walls 28L has a substantially rectangular bead 50*a* protruding toward the inside of the mask frame 30 from the central portion of the side wall 28L and a pair of beads 50*b* which are located on both sides of the bead 50*a*, totally three beads being provided. These beads 50*a*, 50*b* are arranged in line in the lengthwise direction of the side wall 28L. The central bead 50*a* has a larger protrusion toward the inside of the mask frame 30 than those of the beads 50*b*located near the end connecting portions 32*b* and the height of the bead 50*a* in the direction of the axis Z is larger than those of the beads 50*b*.

Each of the side walls 28S has a substantially rectangular bead 52*a* protruding toward the inside of the mask frame 30 from the central portion of the side wall 28S and a pair of beads 52*b* located on both sides of the bead 52*a*, totally three beads being provided. These beads 52*a*, 52*b* are provided in line in the lengthwise direction of the side wall 28S. The bead 52*a* located in the center has a higher height in the direction of the axis Z than a pair of the beads 50*b* located near the end connecting portions 32*b*. The protrusions of the beads 52*a*, 52*b* toward the inside of the mask frame 30 are the same.

Other structure of this embodiment is the same as in the fifth embodiment.

According to the sixth embodiment having such a structure, by providing the side wall 28S with the protruding portions 40, the mechanical strength of the mask frame 30 is improved further and the contacting area between the mask body 27 and mask frame 30 is reduced further. Therefore, the deformation of the mask body 27 is reduced and a deviation of the position of the shadow mask 21 relative to the panel 3 can be effectively prevented.

Further, by providing the side walls 28S with the beads 52*a*, 52*b*, the side walls 28S having a relatively low mechanical strength can be intensified, so that when the shadow mask 21 is attached to or detached from the envelope during manufacturing the color cathode ray tube, a force applied to the mask frame 30 is cut by the protruding portions 34 and 40, thereby reducing an influence upon the central portions of the side walls and further by the reinforcements by the beads 52*a*, 52*b*, the deformation in the vicinity of the central portions of the side walls can be prevented. Additionally, the same operation and effect as the previously described embodiments can be obtained.

Figure 11C:
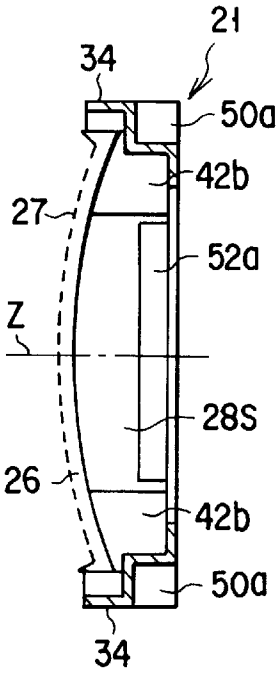
FIG. 11C is a sectional view taken along the lines XIC—XIC of FIG. 11A.
Figure 11A:
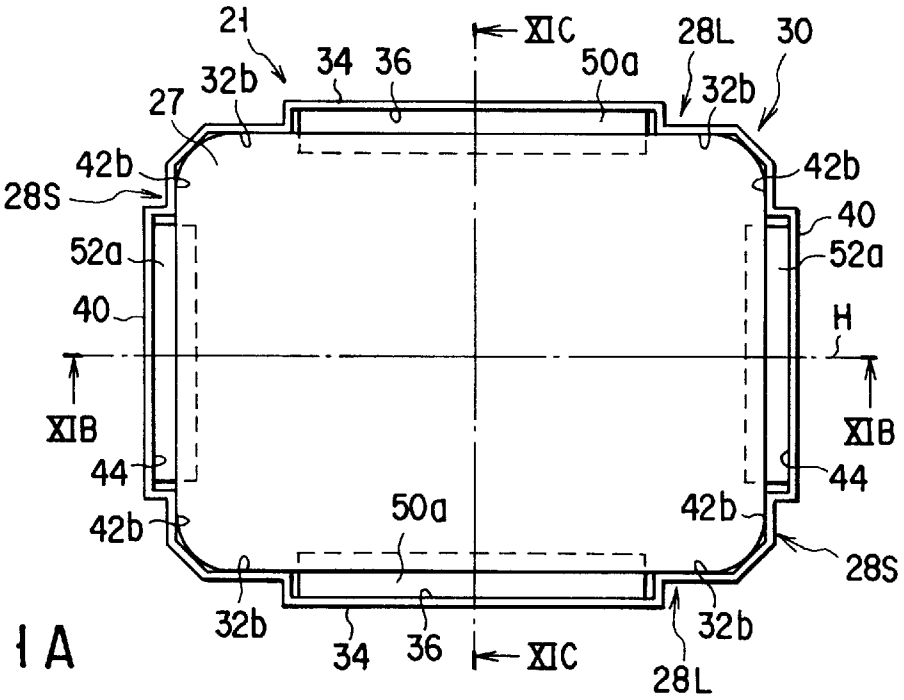
FIG. 11A is a plan view of a shadow mask according to a seventh embodiment of the present invention.
Figure 11B:
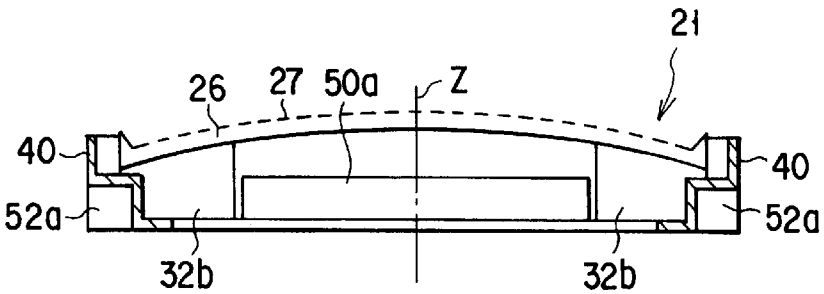
FIG. 11B is a sectional view taken along the lines XIB—XIB of FIG. 11A.

With a shadow mask 21 according to a seventh embodiment shown in FIGS. 11A to 11C, side walls 28L on the long sides of the mask frame 30 and the side walls 28S on the short sides have a protruding portion and bead, respectively. More detail, each of the side walls 28L has a single rectangular protruding portion 34 protruding in a direction to be apart from the mask body 27. The protruding portion 34 is formed symmetrically with respect to the short axis V of the mask frame 30. On both end portions in the lengthwise direction of the side wall 28L, namely, on both sides of the protruding portion 34 are formed end connecting portions 32*b* which are in contact with the skirt portion 26 of the mask body 27.

Each long side portion of the skirt portion 26 of the mask body 27 is located inside the mask frame 30 and is in contact with the end connecting portions 32*b* of the corresponding side wall 28L and welded thereto. A gap 36 is defined between each of the side walls 28L and the mask body 27 by the protruding portion 34. The gap 36 has a predetermined width along the entire length.

Each of the side walls 28L has a single substantially rectangular bead 50*a* protruding toward the inside of the mask frame 30 from the protruding portion 34. The bead 50*a* extends along the entire length of the protruding portion 34 and is formed symmetrically with the short axis V. The bead 50*a* has a constant protruding amount and a constant height. Further, the bead 50*a* is formed on that end portion of the side wall 28L which is near the electron gun 9 such that it is not in contact with the skirt portion 26 of the mask body 27. The bead 50*a* is disposed about 3 mm apart from the end connecting portions 32*b*.

On the other hand, each of the side walls 28S has a single rectangular protruding portion 40 protruding in a direction to be apart from the mask body 27. The protruding portion 40 is formed symmetrically with respect to the long axis H. On both end portions in the lengthwise direction of the side wall 28S, namely, on both sides of the protruding portion 40 are formed end connecting portions 42*b* which are in contact with the skirt portion 26 of the mask body 27.

Each long side portion of the skirt portion 26 of the mask body 27 is located inside the mask frame 30 and is in contact with and welded to the end connecting portions 42*b* of the corresponding side walls 28S. A gap 44 is defined between each of the side walls 28S and the mask body 27 by the protruding portion 40. The gap 44 is formed in a constant width along the entire length.

Each of the side walls 28S has a single substantially rectangular bead 52*a* protruding toward the inside of the mask frame 30 from the protruding portion 40. The bead 52*a* extends along the entire length of the protruding portion 40 and is symmetrical with respect to the long axis H. The bead 52*a* has a constant protruding amount and a constant height. Further, the bead 52*a* is formed on that end portion of the side wall 28S which is near the electron gun 9 such that it is not in contact with the skirt portion 26 of the mask body 27. The bead 52*a* is disposed about 3 mm apart from the end connecting portion 42*b*.

According to the seventh embodiment having such a structure, by providing the side walls 28L and 28S on the long and short sides with the protruding portions 34, 40 respectively, the mechanical strength of the mask frame 30 is improved further and the contacting area between the mask body 27 and mask frame 30 is further reduced. Therefore, the deformation of the mask body 27 is reduced and a deviation of the position of the shadow mask 21 with respect to the panel 3 can be effectively prevented.

Further, by providing the side walls 28L, 28S with the beads 50*a*, 52*b*, the side walls 28L, 28S can be further strengthened, so that when the shadow mask 21 is attached to and detached from the envelope during manufacturing step of the color cathode ray tube, a force applied to the mask frame 30 is cut by the protruding portions 34, 40 thereby reducing an influence upon the central portion of the side walls and further by the reinforcements by the beads 50*a*, 50*b*, the deformation in the vicinity of the central portions of the side walls can be prevented. Additionally, the same operation and effect as the previously described embodiments can be obtained.

Figure 12C:
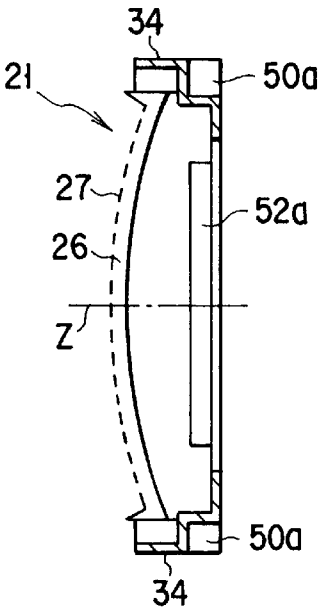
FIG. 12C is a sectional view taken along the lines XIIC–XIIC of FIG. 12A.
Figure 12A:
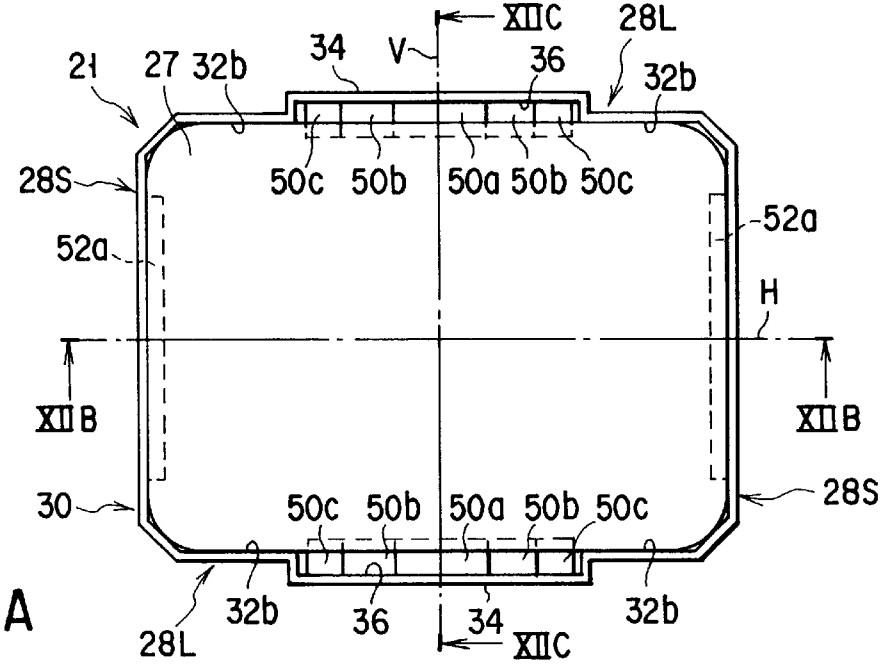
FIG. 12A is a plan view of a shadow mask according to an eighth embodiment of the present invention.
Figure 12B:
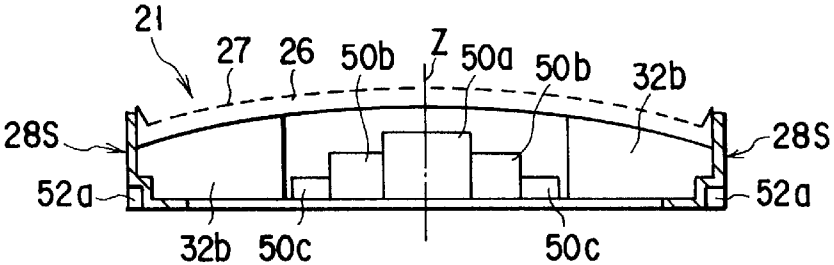
FIG. 12B is a sectional view taken along the lines XIIB—XIIB of FIG. 12A.

With a shadow mask 21 according to an eighth embodiment shown in FIGS. 12A to 12C, each of side walls 28L of the long side of the mask frame 30 has a single rectangular protruding portion 34. The protruding portion 34 is formed symmetrically with respect to the short axis V of the mask frame 30. On both end portions in the lengthwise direction of the side wall 28L are formed end connecting portions 32*b* which are in contact with the skirt portion 26 of the mask body 27.

Each long side portion of the skirt portion 26 of the mask body 27 is located inside the mask frame 30 and is welded to the end connecting portions 32*b* of the corresponding side wall 28L. A gap 36 is defined between each of the side walls 28L and the mask body 27 by the protruding portion 34. The gap 36 is formed in a constant width along the entire length.

Each of the side walls 28L has five substantially rectangular beads 50*a*, 50*b*, 50*c* protruding toward the inside of the mask frame 30 from the protruding portion 34. The beads 50*a*, 50*b*, 50*c* are formed symmetrically with the short axis V. Namely, the beads 50*a* are formed on the central portion in the lengthwise direction of the protruding portions 34, a pair of the beads 50*b* are formed on both sides thereof, and a pair of the beads 50*c* are formed on both sides of the beads 50*b*.

The protrusions of the beads 50*a*, 50*b*, 50*c* are set in a constant amount. As for the height of the beads, the bead 50*a* has the largest height, followed by the bead 50*b* and 50*c* in this order.

On the other hand, each of the side walls 28S has no protruding portion, but has a substantially rectangular bead 52*a* protruding toward the inside of the mask frame 30. The bead 52*a* is formed symmetrically with the long axis H, and has a constant protruding amount and a constant height. The bead 52*a* is formed on that end portion of the side wall 28S which is near the electron gun 9, and is not in contact with the skirt portion 26 of the mask body 27.

In the present embodiment, a ratio between the area S1 of the side wall 28L on the long side and the area S2 of the bead (total area of the beads 50*a*, 50*b*, 50*c*) or S2/S1 is larger than a ratio S4/S3 between the area S3 of the side wall 28S on the short side and the area S4 of the bead 52*a*, such that S2/S1>S4/S3 is set.

According to the eighth embodiment having such a structure, the central portions of both the long and short sides of the mask frame 30 can be reinforced, so that the same effect as in the shadow mask according to the previously described embodiments can be obtained. Particularly if the aforementioned shadow mask 21 is applied to a color cathode ray tube having an aspect ratio of 16:9, the deformation of the long side of the mask frame having a low mechanical strength can be reduced. As a result, deformation in the long and short sides of the mask frame, which is generated by a force applied when the shadow mask is fit or removed, can be balanced, thereby making it possible to manufacture a color cathode ray tube in which a deviation of beam landing on three-color phosphor layers cab be prevented.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a panel having an effective substantially rectangular portion in which a phosphor screen is formed on an inner surface thereof and a skirt portion provided on a periphery of the panel, and a funnel attached to the skirt portion;

a shadow mask arranged in the envelope to oppose the phosphor screen; and an elastic support elastically supporting the shadow mask relative to the skirt portion;

the shadow mask including a substantially rectangular mask body having a number of electron beam passage apertures, and a substantially rectangular mask frame having four side walls supporting the periphery of the mask body, each of at least two side walls opposing each other of the mask frame having a central connecting portion which is provided at a central portion of the side wall in a lengthwise direction thereof and fixed to the mask body, a pair of end connecting portions which are located on both ends of the side wall in the lengthwise direction thereof and fixed to the mask body, and a pair of protruding portions which are provided on both sides of the central connecting portion with respect to the lengthwise direction of the side wall and protrude in a direction away from the mask body, each of the protruding portions defining a gap between the side wall and the mask body, and each gap having a width increasing from the central connecting portion to the end connecting portion, and each gap width being a maximum width between the central connecting portion and the end connecting portion.

2. A color cathode ray tube according to claim 1, wherein each of said at least two side walls has a bead protruding toward the inside of the mask frame from the protruding portion without contacting with the mask body.

3. A color cathode ray tube comprising:

an envelope including a panel having an effective substantially rectangular portion in which a phosphor screen is formed on an inner surface thereof and a skirt portion provided on a periphery of the panel, and a funnel attached to the skirt portion;

a shadow mask arranged in the envelope to oppose the phosphor screen; and an elastic support elastically supporting the shadow mask relative to the skirt portion;

the shadow mask including a substantially rectangular mask body having a number of electron beam passage apertures, and a substantially rectangular mask frame having four side walls supporting the periphery of the mask body, each of at least two side walls opposing each other of the mask frame having a protruding portion protruding in a direction away from the mask body and defining a gap between said side wall and the mask body, and a bead protruding toward the inside of the mask frame from the protruding portion without contacting with the mask body.

4. A color cathode ray tube according to claim 3, wherein the mask frame has a short axis and a long axis which are perpendicular to each other, the four side walls include a pair of long side walls parallel to the long axis and a pair of short side walls parallel to the short axis, and each of the long side walls has said protruding portion and bead.

5. A color cathode ray tube according to claim 4, wherein each of the short side walls has a bead protruding toward the inside of the mask.

6. A color cathode ray tube according to claim 5, wherein a ratio of an area of the bead of the long side wall relative to the area of the long side wall is larger than the ratio of the area of the bead of the short side wall relative to the area of the short side wall.

7. A color cathode ray tube according to claim 4, wherein each of the short side walls has a protruding portion which protrudes in a direction away from the mask body and defines a gap between the short side wall and the mask body, and a bead protruding toward the inside of the mask frame from the protruding portion.

8. A color cathode ray tube according to claim 4, wherein the bead of each of the long side walls is formed symmetrically with the short axis.

9. A color cathode ray tube according to claim 8, wherein each of the long side walls has a plurality of beads disposed symmetrically with the short axis.

10. A color cathode ray tube according to claim 9, wherein each of the long side walls has a first bead located on the short axis, and a pair of second beads located on both sides of the first bead, the protruding amount of the first bead being larger than the protruding amount of the second beads.

11. A color cathode ray tube according to claim 9, wherein each of the long side walls has a first bead located on the short axis, and a pair of second beads located on both sides of the first bead, the height of the first bead in a width direction of the long side wall being larger than the height of the second beads.

12. A color cathode ray tube comprising:

an envelope including a panel having an effective substantially rectangular portion in which a phosphor screen is formed on an inner surface thereof and a skirt portion provided on a periphery of the panel, and a funnel attached to the skirt portion;

a shadow mask arranged in the envelope to oppose the phosphor screen; and an elastic support elastically supporting the shadow mask relative to the skirt portion;

the shadow mask including a substantially rectangular mask body having a number of electron beam passage apertures, and a substantially rectangular mask frame having four side walls supporting the periphery of the mask body, each of at least two side walls opposing each other of the mask frame having a central connecting portion which is provided at a central portion of the side wall in a lengthwise direction thereof and fixed to the mask body; a pair of end connecting portions which are located on both ends of the side wall in the lengthwise direction thereof and fixed to the mask body; a middle connecting portion which is located between the central connecting portion and each end connecting portion and fixed to the mask body; a pair of first protruding portions each of which is formed between the central connecting portion and the middle connecting portion and protrudes in a direction away from the mask body; and a pair of second protruding portions each of which is formed between the middle connecting portion and the end connecting portion and protrudes in a direction away from the mask body;

each of the first protruding portions defining a gap between the side wall and the mask body, whose width continuously increases from the central connecting portion up to the middle connecting portion, and each of the second protruding portions defining a gap between the side wall and the mask body, whose width continuously increases from the middle connecting portion up to the end connecting portion.

* * * * *